US009836997B1

(12) United States Patent
Brandrup

(10) Patent No.: US 9,836,997 B1
(45) Date of Patent: Dec. 5, 2017

(54) POP-UP GREETING CARD WITH LOCKING MECHANISM

(71) Applicant: Up With Paper, LLC, Mason, OH (US)

(72) Inventor: Monika Brandrup, Guilford, CT (US)

(73) Assignee: Up With Paper, LLC, Mason, OH (US)

( * ) Notice: Subject to any disclaimer, the term of this patent is extended or adjusted under 35 U.S.C. 154(b) by 0 days.

(21) Appl. No.: 15/375,216

(22) Filed: Dec. 12, 2016

(51) Int. Cl.
*G09F 1/06* (2006.01)
*B42D 15/04* (2006.01)

(52) U.S. Cl.
CPC ..... *G09F 1/06* (2013.01); *B42D 15/042* (2013.01)

(58) Field of Classification Search
CPC ..... G09F 1/06; B42D 15/04; B42D 15/042; B65D 5/4258
See application file for complete search history.

(56) References Cited

U.S. PATENT DOCUMENTS 930,108 A * 8/1909 Walcutt ..... B42D 15/042 119/430
2,511,211 A * 6/1950 Klein ..... B65D 5/4258 206/45.28
2,742,723 A * 4/1956 Klein ..... B42D 15/04 40/124.09
5,562,520 A * 10/1996 Pridonoff ..... A63H 3/52 40/124.14
6,966,135 B1 11/2005 McDonald
7,395,622 B2 * 7/2008 Malkovas ..... G09F 1/04 40/124.08

FOREIGN PATENT DOCUMENTS

JP 2013114255 A * 6/2013

* cited by examiner

*Primary Examiner* — Cassandra H Davis

(74) *Attorney, Agent, or Firm* — Wood Herron & Evans LLP

(57) ABSTRACT

A locking mechanism is provided for a pop-up greeting card. The card includes first and second generally planar panels which are connected to each other at a fold line. A plurality of pop-up elements extend from the inner surface of the first panel to the inner surface of the second panel. The card includes a locking mechanism having a pivoting tab which can engage a stop member, maintaining the card in an open position. Selecting the appropriate length of the tab determines the angle that the card can be opened. The stop mechanism can be located on either the first or second panels or on one of the panels and a pop-up element.

5 Claims, 4 Drawing Sheets

POP-UP GREETING CARD WITH LOCKING MECHANISM

BACKGROUND OF THE INVENTION

Pop-up greeting cards are three dimensional (3-D) displays that fold flat and open up to display 3-D elements or pop-ups. The cards are generally formed from paper stock or plastic and have two panels connected at a fold line. Pop-up elements are connected to both of the panels and fold as the panels close on each other, allowing the greeting card to basically lie flat. Likewise, as the panels are opened up, the pop-up elements rise to present a 3-D display.

These cards naturally tend to close unless an opening force is maintained. In certain applications, it is desirable to keep the 3-D display opened. A locking mechanism which has been employed in the past is a rectangular piece of cardstock which is adhered to one of the panels at the fold line. This folds outwardly, such that a free edge of the rectangular card stock engages the other of the panels, basically holding the panels at a 90° angle. This mechanism is not particularly effective. The cardstock tends to be flimsy and does not continue functioning over time. It also only holds the card open at 90° or less.

SUMMARY OF THE INVENTION

The present invention provides a pop-up greeting card which can be locked in the open position. The card is formed from first and second panels which are pivotally attached to each other at fold line. One or more pop-up elements are connected to the first and second panels. A locking mechanism includes a tab which is fixed to either of the panels and a stop member positioned on the other of the panels. When the greeting card is opened, the tab is pivoted so that it engages the stop and maintains the card in an open position. The length of tab and the position of the stop member determines the angle at which the card is opened.

The invention will be further appreciated in light of the following detailed descriptions and drawings, in which:

DETAILED DESCRIPTION OF THE INVENTION

Figure 1:
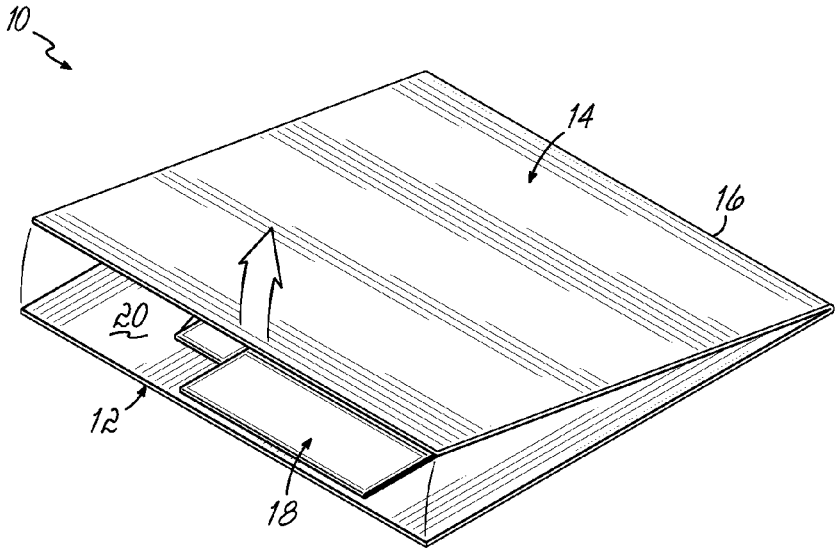
FIG. 1 is a perspective view of the present invention in a closed state.

As shown in FIG. 1, a greeting card 10 includes a first planar panel 12 and a second planar panel 14 connected together along the fold line 16. As shown, the panels are rectangular but these can take any shape whatsoever, depending on the desired ornamental appearance of the final end product. The greeting card 10 further includes one or more pop-up elements 18. Typically, the card will include several, often elaborate pop-up elements. But only one is shown.

Each pop-up element 18 includes a first portion 24, and a second portion 28 connected directly or indirectly to each other. The first portion 24 is attached to the inner surface 20 of first panel 12 with tab 25 (shown in hidden line) fixed to panel 12 and connected to the first portion at fold lines 27. The tab 25 is shown in hidden line because it may be on surface 20 or may be adhered behind surface 20 so that it is not visible. The second portion 28, in turn, is connected to the inner surface 22 of second panel 14. Second portion 28 foldably connects the pop-up element 18 to second panel 14. As shown, portion 28 is formed from a panel **28*a* and a strip 28*b* which is attached to surface 22 with a tab 29 (shown in hidden line) with a fold line 30 between tab 29 and strip 28*b***.

The second portion 28 as shown is exemplary. Panel 28 could be a single panel directly connected to surface 22. Alternately, panel 28 could be multiple panels with multiple fold lines which ultimately connect to surface 22. Any direct or indirect connection which allows the pop-up elements to fold flat when the panels are closed on each other and stand up when the panels are opened can be used.

The greeting card 10 further includes a locking mechanism 32 which, as shown, includes a tab 34 having a first portion 36 (in hidden line) affixed to second panel 14 and a second portion 38 which can pivot relative to the first portion at fold line 40 (as shown by arrow 39). The locking feature 32 further includes a stop or engagement member 42 which is fixed to or part of the inner surface 20 of the first planar panel 12. Both the tab 34 and engagement member 42 are adjacent the fold line 16, one on each of the respective panels. As shown, the stop member 42 is simply a rectangular piece of paper stock which includes a slot 46. The slot is sized to receive the leading edge 35 of tab 34. The stop member can be any structure that can be used to engage the bottom edge 35 of tab 34. For example, the stop mechanism can simply be any structure that raises above the surface of the inner surface 20. The stop member can be a pop-up. It can also be a slot in the first planar panel 20. Likewise, the tab 34 can be paper or cardstock. If desired, the first portion 36 can be thinner than the second portion. For example, first portion 36 can be a single ply of paper and second portion 38 can be two three or more plies to provide rigidity.

Further, the length of the second portion 38 of tab 34 can be established to determine the angle 41 between the first and second planar panels 12 and 14. This angle can be fixed at 80°, 90°, 100°, 120°, 140° or even higher, up to 180° by simply lengthening or shortening portion 38 and properly locating the stop member 42.

Figure 2:
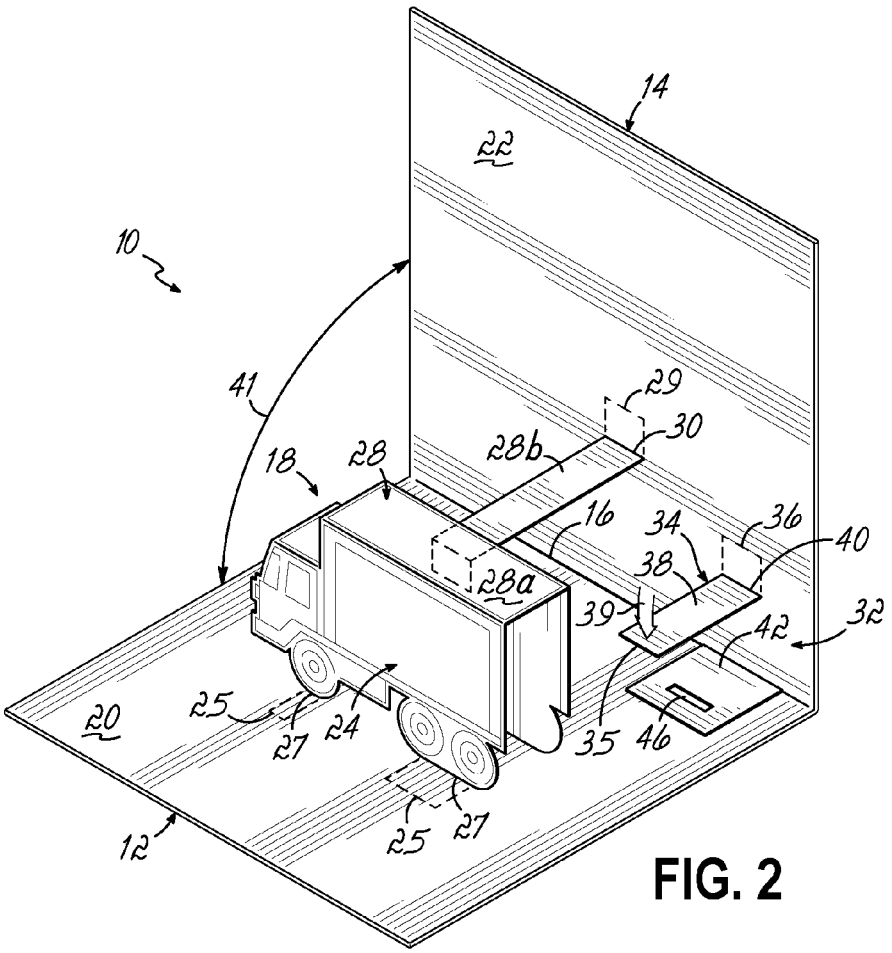
FIG. 2 is a perspective view of the present invention in an open state.
Figure 3:
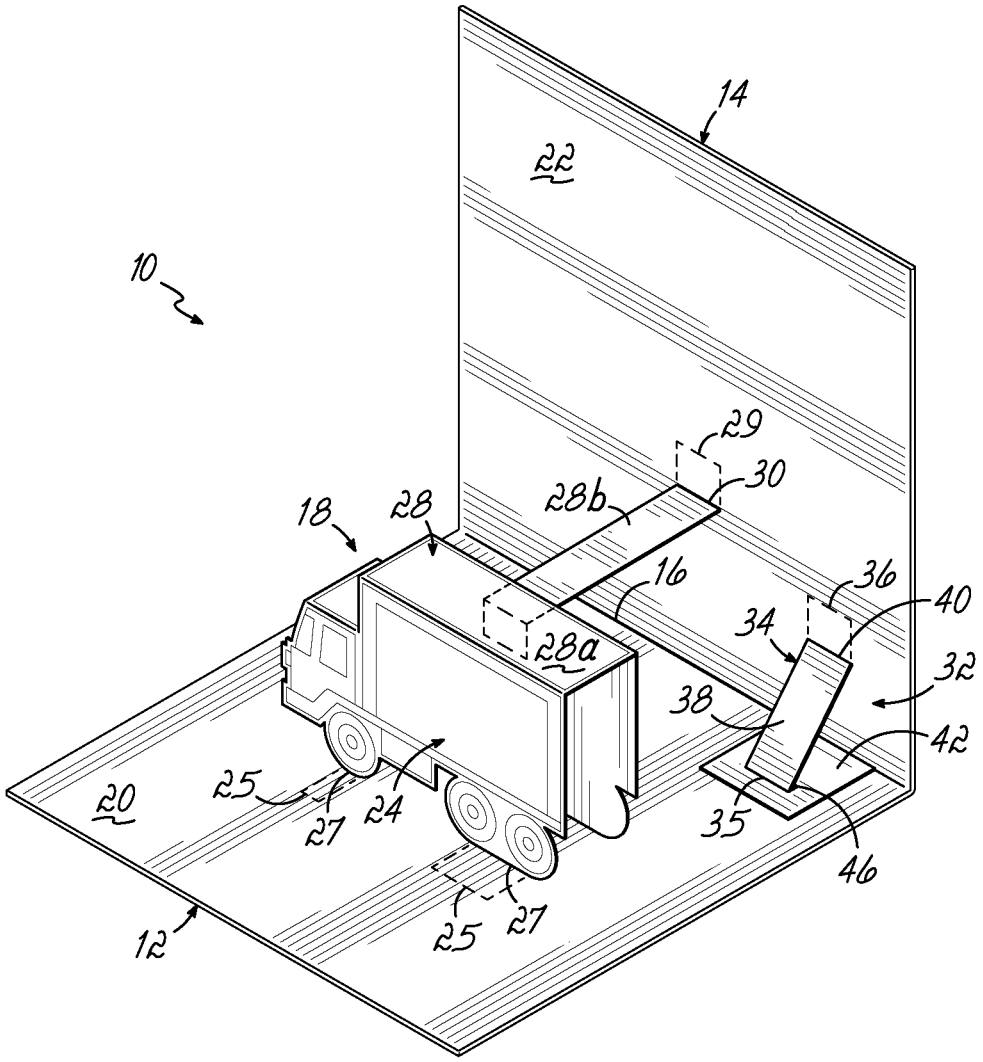
FIG. 3 is a view similar to FIG. 2 showing the locking mechanism engaged.

In operation, greeting card 10, which would be in a flat position as shown in FIG. 1 when removed from an envelope or package, is opened by separating the first and second planar panels 12 and 14. This will cause the pop-up element 18 to rise as designed as shown in FIG. 2. The second portion 38 of tab 34 would be pivoted at fold line 40 and with the bottom edge 35 positioned in slot 46. See FIG. 3. This will maintain the first and second planar panels 12 and 14 at approximately 90° relative to each other or any other angle as desired. Fold line 40 and fold line 16 are parallel to each other so that panels 12 and 14 pivot along the same axis as tab 34. Because the pop-up card 10 is biased toward the closed position, the lock member remains engaged.

To store the greeting card, the second portion 38 of tab 34 is removed from the slot 46 pivoted upwardly and the card closed.

Figure 4:
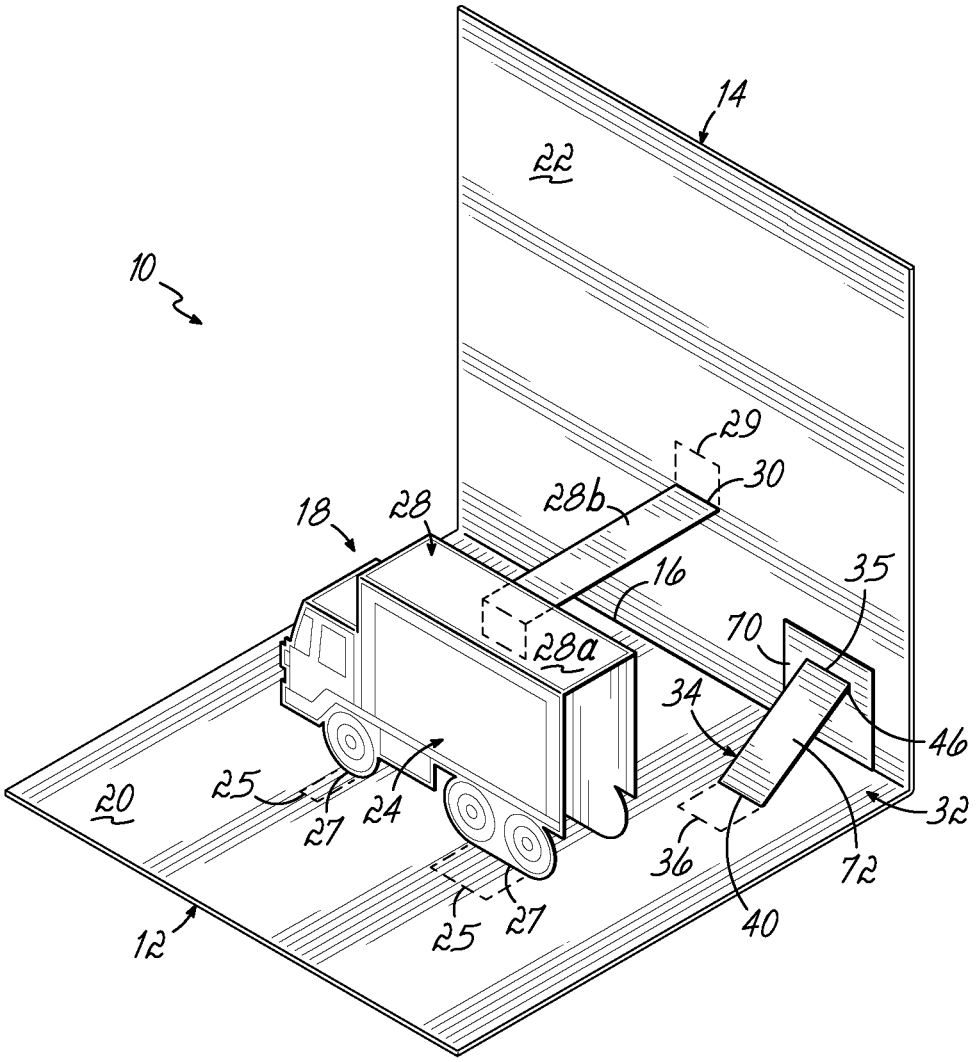
FIG. 4 is a view similar to FIG. 3 of a first alternative embodiment of the present invention.

FIG. 4 shows a first alternate embodiment of the present invention. In this embodiment, the stop member 70 is positioned on the inner surface 22 of the second planar panel 14 and tab 72 is attached to inner surface 20 of the first planar panel 12. When the card 10 is opened, tab 72 is pivoted upwardly and engages the stop member 70, holding the card in an open position.

Figure 5:
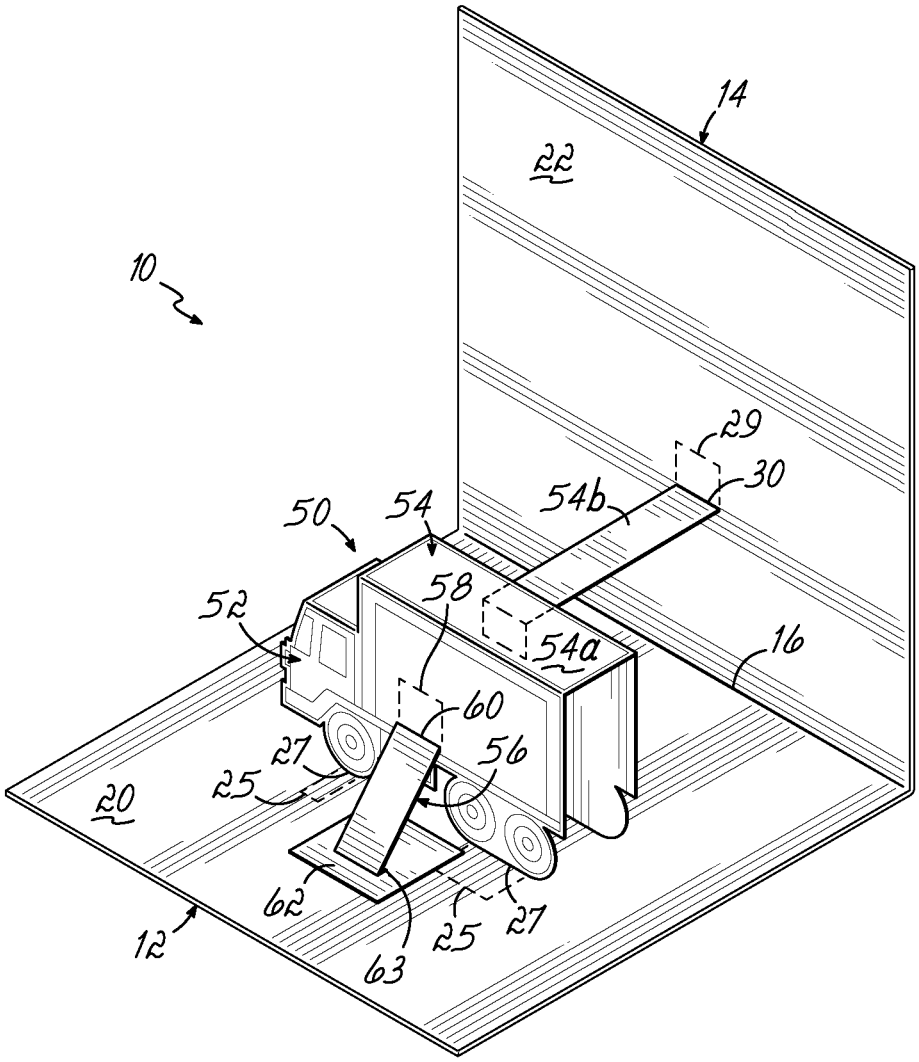
FIG. 5 is a view similar to FIG. 3 of a second alternative embodiment of the present invention.

FIG. 5 shows a second alternate locking mechanism for use in the present invention. This embodiment 10 includes first and second planar panels 12 and 14 and includes a pop-up element 50 which includes a first portion 52 of pop-up element 50 fixed to the first planar panel 12 and a second portion 54 comprising a panel 54(*a*) and a strip 54(*b*) fixed to the second panel 14. A tab 56 similar to tab 34 is positioned on the first portion 52 of the pop-up member 50 with a first tab portion 58 adhered to the first portion 52 of the pop-up member 50 at fold line 60. A stop member 62 (similar to stop member 42) is located on the inner surface 20 of the first planar panel 12. Again, when this card is opened, tab 56 pivots downwardly and engages the slot 63 in stop member 62, which will hold the first and second planar panels at a desired angle.

This lock mechanism for pop-up greeting cards of the present invention is very reliable. Further, this lock mechanism allows for the designer of the card to select the desired angle of the first planar panel relative to the second planar panel of the greeting card, so that the angle can be less than 90°, 90° or greater than 90°, up to 180°. This provides greater design flexibility and further allows these cards to be used as displays without any additional mechanism to hold the cards in an opened position.

This has been a description of the present invention, along with the preferred method of practicing presentation. However, The invention itself should only be defined by the appended claims, wherein I claim:

1. A pop-up greeting card having:

a first panel having a first edge;

a second panel having a second edge;

said first and second panels pivotally connected to each other at said first and second edges;

a pop-up member foldably connected to one of said first and second panels;

a tab pivotally attached to a first inside surface of said first panel;

a stop member adapted to engage an edge of said tab, said stop member attached to a second inside surface of said second panel;

wherein said stop member is a piece of stock fixed to said second inside surface;

whereby said tab maintains said card in an open position when said edge of said tab engages said stop member.

2. The pop-up greeting card claimed in claim 1 wherein said stop member includes a slot adapted to receive said edge of said tab.

3. The pop-up greeting card claimed in claim 1 wherein said tab is adapted to hold said first panel relative to said second panel at approximately a 90° angle.

4. The pop-up greeting card claimed in claim 1 wherein said tab is adapted to maintain said first panel relative to said second panel at an angle greater than 90°.

5. A pop-up greeting card having a first panel having a first edge and a second panel having a second edge;

wherein said first and second panels are pivotally connected at said first and second edges along a fold line;

a pop-up member having first and second portions, said pop-up member foldably connected to said first and second panels;

wherein said first portion of said pop-up member includes a first element of a stop mechanism and an inner surface of said first panel includes a second element of said stop mechanism;

wherein one of said first and second elements is a tab pivoting on an axis parallel to said fold line and the other of said elements is a separate piece of stock having a slot, said slot adapted to engage an edge of said tab wherein said piece of stock is positioned on an inner surface of said first panel.

* * * * *